US011892206B2

(12) United States Patent
Kanatani

(10) Patent No.: US 11,892,206 B2
(45) Date of Patent: Feb. 6, 2024

(54) HEAT EXCHANGER AND REFRIGERATION CYCLE APPARATUS

(71) Applicant: Mitsubishi Electric Corporation, Tokyo (JP)

(72) Inventor: Toshiki Kanatani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 283 days.

(21) Appl. No.: 17/427,344

(22) PCT Filed: Mar. 26, 2019

(86) PCT No.: PCT/JP2019/012903

§ 371 (c)(1),
(2) Date: Jul. 30, 2021

(87) PCT Pub. No.: WO2020/194517

PCT Pub. Date: Oct. 1, 2020

(65) Prior Publication Data

US 2022/0113069 A1 Apr. 14, 2022

(51) Int. Cl.

| | |
|---|---|
| ***F25B 39/02*** | (2006.01) |
| ***F28D 1/047*** | (2006.01) |
| ***F28F 1/40*** | (2006.01) |

(52) U.S. Cl.

CPC ..... *F25B 39/02* (2013.01); *F28D 1/047* (2013.01); *F28F 1/40* (2013.01); *F28F 2210/02* (2013.01); *F28F 2215/12* (2013.01)

(58) Field of Classification Search

CPC . F25B 39/02; F28D 1/047; F28D 1/04; F28D 1/0417; F28D 1/05308;

(Continued)

(56) References Cited

U.S. PATENT DOCUMENTS 4,044,797 A * 8/1977 Fujie ..... F28F 13/187 165/184
4,570,700 A * 2/1986 Ohara ..... F28F 1/02 165/170

(Continued)

FOREIGN PATENT DOCUMENTS

JP H03-102193 A 4/1991
JP H05-248785 A 9/1993

(Continued)

OTHER PUBLICATIONS

Office Action dated Jul. 26, 2022 issued in the counterpart Japanese Application No. 2021-508479 (and English translation).

(Continued)

*Primary Examiner* — Justin M Jonaitis
(74) *Attorney, Agent, or Firm* — POSZ LAW GROUP, PLC

(57) ABSTRACT

A heat exchanger includes a distributor, and a first heat transfer tube and a second heat transfer tube connected in parallel with each other with respect to the distributor. The first heat transfer tube is disposed above the second heat transfer tube. The first heat transfer tube has a first inner circumferential surface, and at least one first groove recessed relative to the first inner circumferential surface and arranged side by side in a circumferential direction of the heat transfer tube. The second heat transfer tube has a second inner circumferential surface, and at least one second groove recessed relative to the second inner circumferential surface and arranged side by side in a circumferential direction. An internal pressure loss of the first heat transfer tube is smaller than an internal pressure loss of the second heat transfer tube.

17 Claims, 9 Drawing Sheets

(58) Field of Classification Search
CPC ..... F28D 1/05316; F28D 1/05358; F28D 1/05366; F28F 1/40; F28F 2210/02; F28F 2215/12; F28F 1/10; F28F 1/105; F28F 1/126; F28F 1/128
USPC ..... 165/152, 150, 176
See application file for complete search history.

(56) References Cited

U.S. PATENT DOCUMENTS 4,705,103 A * 11/1987 Zogg ..... F28F 1/40 165/110
5,076,353 A * 12/1991 Haussmann ..... F28D 1/0478 165/113
5,529,116 A * 6/1996 Sasaki ..... F28D 1/0435 165/145
8,495,894 B2 * 7/2013 Kerler ..... F28F 9/0204 62/515
9,568,221 B2 * 2/2017 Suhara ..... F25B 13/00
2008/0041559 A1 * 2/2008 Woong ..... F28F 1/126 165/44
2016/0223265 A1 * 8/2016 Jindou ..... F28F 1/128

FOREIGN PATENT DOCUMENTS

JP H06281293 A * 10/1994
JP H07-027359 A 1/1995
JP H09-189462 A 7/1997
JP 2012-167913 A 9/2012
JP 2018-059673 A 4/2018
WO 2012/147336 A1 11/2012

OTHER PUBLICATIONS

International Search Report dated Jun. 25, 2019, issued in corresponding International Application No. PCT/JP2019/012903 (and English translation).
Office Action dated Jan. 5, 2023 issued in corresponding Chinese Patent Application No. 201980094118.6 (and English translation).

* cited by examiner

HEAT EXCHANGER AND REFRIGERATION CYCLE APPARATUS

CROSS REFERENCE TO RELATED APPLICATION

This application is a U.S. national stage application of International Patent Application No. PCT/JP2019/012903 filed on Mar. 26, 2019, the disclosure of which is incorporated herein by reference.

TECHNICAL FIELD

The present invention relates to a heat exchanger and a refrigeration cycle apparatus.

BACKGROUND

Japanese Patent Laying-Open No. 2018-059673 discloses a heat exchanger in which an inflow pipe and an outflow pipe connected to a distributor are each provided with flow rate control means. The flow rate control means controls a flow rate through each of the inflow pipe and the outflow pipe, to uniformly distribute gas-liquid two-phase refrigerant to heat transfer tubes disposed relatively above and heat transfer tubes disposed relatively below.

PATENT LITERATURE

PTL 1: Japanese Patent Laying-Open No. 2018-059673

The heat exchanger described above, however, includes the flow rate control means in addition to the distributor, the heat transfer tubes, fins, and the like, and therefore has an increased size compared to a heat exchanger without the flow rate control means. The heat exchanger described above also requires a higher cost of manufacturing than a heat exchanger without the flow rate control means.

SUMMARY

A main object of the present invention is to provide a heat exchanger and a refrigeration cycle apparatus, the heat exchanger being capable of uniformly distributing gas-liquid two-phase refrigerant to a heat transfer tube disposed relatively above and a heat transfer tube disposed relatively below, and having a reduced size compared to a conventional heat exchanger.

A refrigeration cycle apparatus according to the present invention includes a distributor, and a first heat transfer tube and a second heat transfer tube connected in parallel with each other with respect to the distributor. The first heat transfer tube is disposed above the second heat transfer tube. The first heat transfer tube has a first inner circumferential surface, and at least one first groove recessed relative to the first inner circumferential surface and arranged side by side in a circumferential direction of the heat transfer tube. The second heat transfer tube has a second inner circumferential surface, and at least one second groove recessed relative to the second inner circumferential surface and arranged side by side in a circumferential direction. An internal pressure loss of the first heat transfer tube is smaller than an internal pressure loss of the second heat transfer tube.

According to the present invention, a heat exchanger and a refrigeration cycle apparatus can be provided, the heat exchanger being capable of uniformly distributing gas-liquid two-phase refrigerant to a heat transfer tube disposed relatively above and a heat transfer tube disposed relatively below, and having a reduced size compared to a conventional heat exchanger.

DETAILED DESCRIPTION

Figure 1:
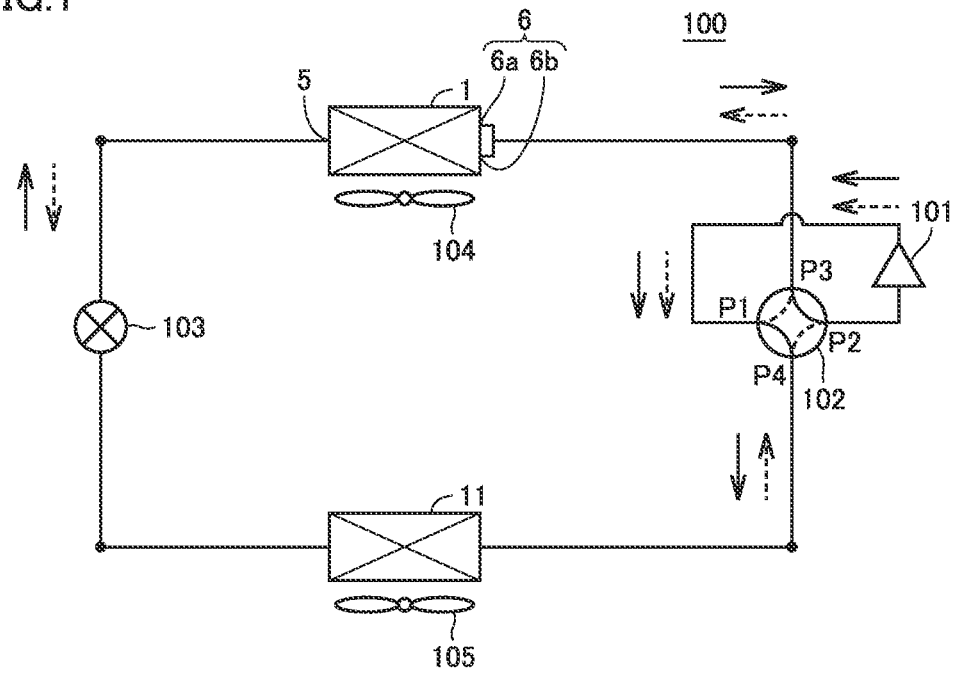
FIG. 1 is a diagram showing a refrigeration cycle apparatus according to a first embodiment.

Embodiments of the present invention will be described hereinafter in detail with reference to the drawings. The same or corresponding parts in the drawings are designated by the same characters and a description thereof will not be repeated in principle.

First Embodiment

<Configuration of Refrigeration Cycle Apparatus>

As shown in FIG. 1, a refrigeration cycle apparatus 100 according to a first embodiment includes a refrigerant circuit through which refrigerant circulates. The refrigerant circuit includes a compressor 101, a four-way valve 102 as a flow path switching unit, a decompression unit 103, a first heat exchanger 1, and a second heat exchanger 11. Refrigeration cycle apparatus 100 further includes a first fan 104 that blows air to first heat exchanger 1, and a second fan 105 that blows air to second heat exchanger 11.

Compressor 101 has a discharge port through which to discharge the refrigerant, and a suction port through which to suck the refrigerant. Decompression unit 103 is an expansion valve, for example. Decompression unit 103 is connected to a third inflow/outflow portion 5 of first heat exchanger 1.

Four-way valve 102 has a first opening P1 connected to the discharge port of compressor 101 via a discharge pipe, a second opening P2 connected to the suction port of compressor 101 via a suction pipe, a third opening P3 connected to a first inflow/outflow portion 6*a* and a second inflow/outflow portion 6*b* of first heat exchanger 1, and a fourth opening P4 connected to second heat exchanger 11. Four-way valve 102 is provided to switch between a first state in which first heat exchanger 1 serves as a condenser and second heat exchanger 11 serves as an evaporator, and a second state in which second heat exchanger 11 serves as a condenser and first heat exchanger 1 serves as an evaporator. Note that solid line arrows shown in FIG. 1 indicate a flow direction of the refrigerant circulating through the refrigerant circuit when refrigeration cycle apparatus 100 is in the first state. Dotted line arrows shown in FIG. 1 indicate a flow direction of the refrigerant circulating through the refrigerant circuit when refrigeration cycle apparatus 100 is in the second state.

<Configuration of First Heat Exchanger>

Figure 2:
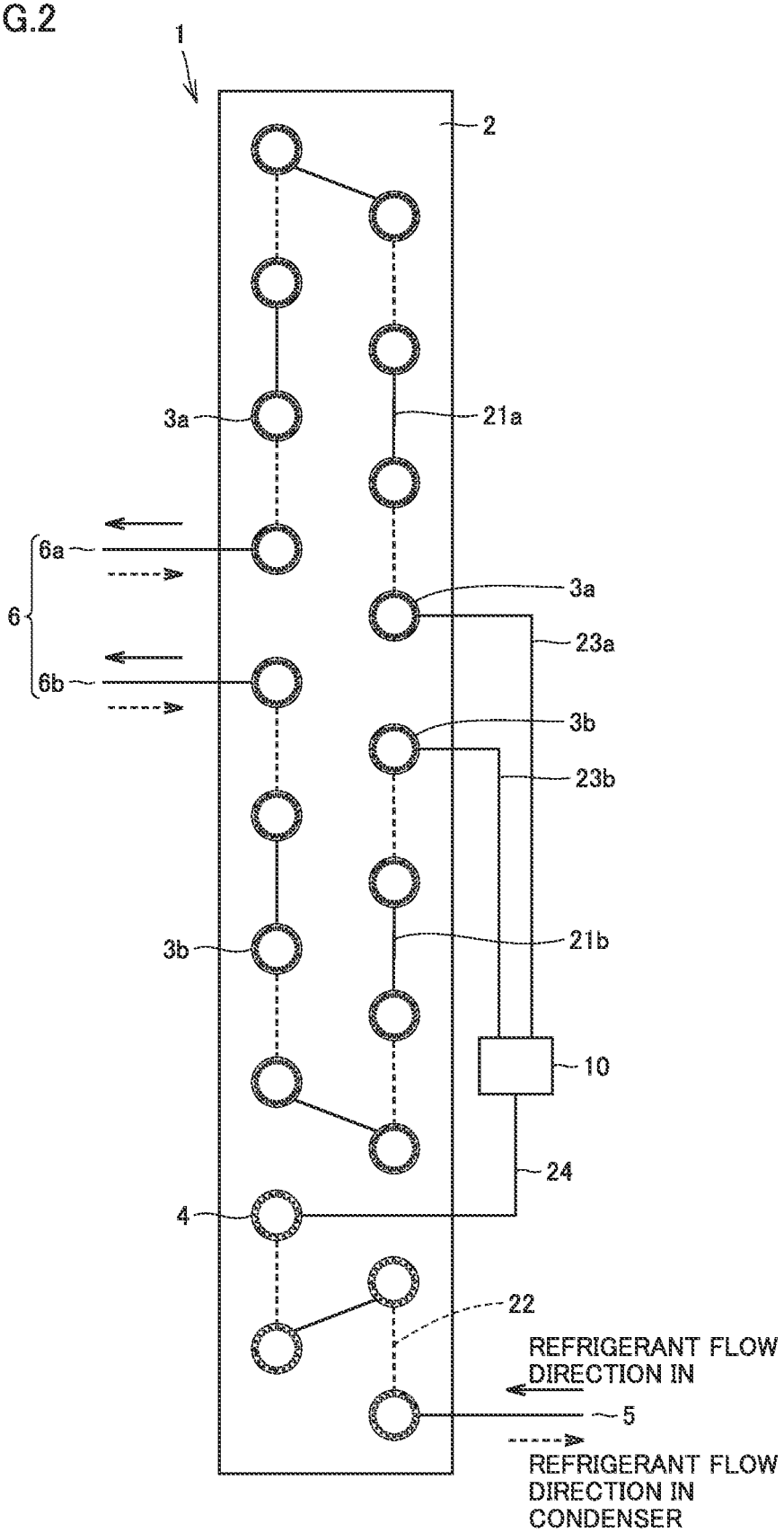
FIG. 2 is a diagram showing a heat exchanger according to the first embodiment.

As shown in FIG. 2, first heat exchanger 1 mainly includes, for example, a plurality of fins 2, a plurality of first heat transfer tubes 3*a*, a plurality of second heat transfer tubes 3*b*, a plurality of third heat transfer tubes 4, and a distributor 10. First heat exchanger 1 is provided such that gas flowing toward a direction along the plurality of fins 2 exchanges heat with the refrigerant flowing through the plurality of first heat transfer tubes 3*a*, the plurality of second heat transfer tubes 3*b*, and the plurality of third heat transfer tubes 4. The plurality of first heat transfer tubes 3*a*, the plurality of second heat transfer tubes 3*b*, and the plurality of third heat transfer tubes 4 are disposed in parallel with one another.

As shown in FIG. 2, each of the plurality of first heat transfer tubes 3*a* is disposed above each of the plurality of second heat transfer tubes 3*b*. Here, each of the plurality of first heat transfer tubes 3*a* being disposed above each of the plurality of second heat transfer tubes 3*b* means that, in the second state in which first heat exchanger 1 serves as an evaporator, a flow inlet through which the refrigerant flows into each first heat transfer tube 3*a* is disposed above a flow inlet through which the refrigerant flows into each second heat transfer tube 3*b*.

Each of the plurality of second heat transfer tubes 3*b* is disposed above each of the plurality of third heat transfer tubes 4, for example. Here, each of the plurality of second heat transfer tubes 3*b* being disposed above each of the plurality of third heat transfer tubes 4 means that, in the second state in which first heat exchanger 1 serves as an evaporator, the flow inlet through which the refrigerant flows into each second heat transfer tube 3*b* is disposed above a flow inlet through which the refrigerant flows into each third heat transfer tube 4.

As shown in FIG. 2, the plurality of first heat transfer tubes 3*a* are connected in series with one another via a first connection portion 21*a*. The plurality of second heat transfer tubes 3*b* are connected in series with one another via a second connection portion 21*b*. The plurality of third heat transfer tubes 4 are connected in series with one another via a third connection portion 22.

As shown in FIG. 2, the plurality of first heat transfer tubes 3*a* are connected in series with distributor 10 via a fourth connection portion 23*a*. The plurality of second heat transfer tubes 3*b* are connected in series with distributor 10 via a fifth connection portion 23*b*. The plurality of third heat transfer tubes 4 are connected in series with distributor 10 via a sixth connection portion 24. First connection portion 21*a*, second connection portion 21*b*, third connection portion 22, fourth connection portion 23*a*, fifth connection portion 23*b*, and sixth connection portion 24 are each configured as a connection pipe that connects two inlet/outlet ports in series. In FIG. 2, first connection portion 21*a*, second connection portion 21*b*, and third connection portion 22 indicated by solid lines are connected to respective one ends of the plurality of heat transfer tubes 3 and 4, while first connection portion 21*a*, second connection portion 21*b*, and third connection portion 22 indicated by dotted lines are connected to respective other ends of the plurality of heat transfer tubes 3 and 4.

As shown in FIG. 2, distributor 10 has a first port P5 connected to first heat transfer tubes 3*a* via fourth connection portion 23*a*, a second port P6 connected to second heat transfer tubes 3*b* via fifth connection portion 23*b*, and a third port P7 connected to third heat transfer tubes 4 via sixth connection portion 24. First port P5 and second port P6 are disposed above third port P7. Distributor 10 has a refrigerant flow path connecting first port P5 to third port P7, and a refrigerant flow path connecting second port P6 to third port P7. A pressure loss of the refrigerant flow path connecting first port P5 to third port P7 is set to be equal to a pressure loss of the refrigerant flow path connecting second port P6 to third port P7, for example.

First heat transfer tubes 3*a* connected in series with one another via first connection portion 21*a* form a first refrigerant flow path. Second heat transfer tubes 3*b* connected in series with one another via second connection portion 21*b* form a second refrigerant flow path. The plurality of third heat transfer tubes 4 connected in series with one another via third connection portion 22 form a third refrigerant flow path. The first refrigerant flow path is disposed above the second refrigerant flow path. The second refrigerant flow path is disposed above the third refrigerant flow path, for example.

The first refrigerant flow path and the second refrigerant flow path form branched paths diverging from the third refrigerant flow path. The first refrigerant flow path and the second refrigerant flow path are connected in series with the third refrigerant flow path via distributor 10. First heat transfer tubes 3*a* and second heat transfer tubes 3*b* are connected in parallel with each other with respect to distributor 10. First heat transfer tubes 3*a* and second heat transfer tubes 3*b* are each connected in series with the plurality of third heat transfer tubes 4 via distributor 10.

The first refrigerant flow path has one end connected to first port P5 of distributor 10. The second refrigerant flow path has one end connected to second port P6 of distributor 10. The first refrigerant flow path has the other end connected to first inflow/outflow portion 6*a*. The second refrigerant flow path has the other end connected to second inflow/outflow portion 6*b*. The first refrigerant flow path has the other end connected to third opening P3 in four-way valve 102 via first inflow/outflow portion 6*a*. The second refrigerant flow path has the other end connected to third opening P3 in four-way valve 102 via second inflow/outflow portion 6*b*. The first refrigerant flow path connecting first port P5 of distributor 10 to first inflow/outflow portion 6*a* has a flow path length equal to that of the second refrigerant flow path connecting second port P6 of distributor 10 to second inflow/outflow portion 6*b*, for example. The third refrigerant flow path has one end connected to decompression unit 103 via third inflow/outflow portion 5. The third refrigerant flow path has the other end connected to respective one ends of the first refrigerant flow path and the second refrigerant flow path via distributor 10.

As shown in FIGS. 2 to 5, the plurality of first heat transfer tubes 3*a*, the plurality of second heat transfer tubes 3*b*, and the plurality of third heat transfer tubes 4 are each configured as a circular tube. An internal pressure loss of the plurality of first heat transfer tubes 3*a* is smaller than an internal pressure loss of the plurality of second heat transfer tubes 3*b*. Preferably, the internal pressure loss of the plurality of first heat transfer tubes 3*a* is greater than an internal pressure loss of the plurality of third heat transfer tubes 4.

Each first heat transfer tube 3*a* has an outer shape identical to that of each second heat transfer tube 3*b*, for example. Each first heat transfer tube 3*a* has an outer diameter equal to that of each second heat transfer tube 3*b*, for example. Each third heat transfer tube 4 has an outer shape identical to that of each first heat transfer tube 3*a* and each second heat transfer tube 3*b*, for example. Each third heat transfer tube 4 has an outer diameter equal to that of each first heat transfer tube 3*a* and each second heat transfer tube 3*b*, for example.

Figure 3:
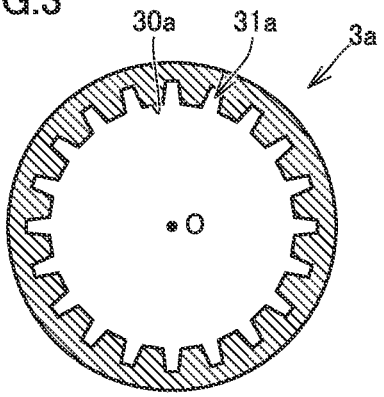
FIG. 3 is a cross-sectional view showing a first heat transfer tube of the heat exchanger shown in FIG. 2.

As shown in FIG. 3, each of the plurality of first heat transfer tubes 3*a* has a first inner circumferential surface 30*a* and a plurality of first grooves 31*a*. First inner circumferential surface 30*a* is a surface that makes contact with the refrigerant flowing through first heat transfer tube 3*a*. Each first groove 31*a* is recessed relative to first inner circumferential surface 30*a*. Each of the plurality of first grooves 31*a* has a similar configuration, for example. First grooves 31*a* are spaced from one another in the circumferential direction of first heat transfer tube 3*a*. Each first groove 31*a* is provided in spiral form with respect to a central axis O of first heat transfer tube 3*a*. Each first groove 31*a* intersects the radial direction of first heat transfer tube 3*a*. Each first groove 31*a* is provided such that its width in the circumferential direction decreases toward the outer circumference of first heat transfer tube 3*a* in the radial direction, for example.

Figure 4:
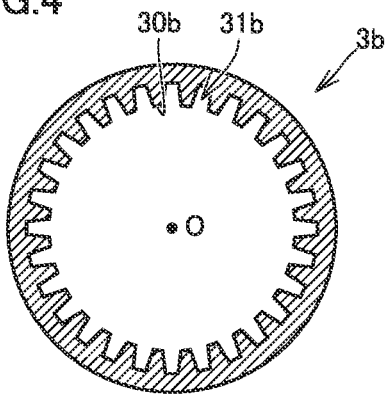
FIG. 4 is a cross-sectional view showing a second heat transfer tube of the heat exchanger shown in FIG. 2.

As shown in FIG. 4, each of the plurality of second heat transfer tubes 3*b* has a second inner circumferential surface 30*b* and a plurality of second grooves 31*b*. Second inner circumferential surface 30*b* is a surface that makes contact with the refrigerant flowing through second heat transfer tube 3*b*. Each second groove 31*b* is recessed relative to second inner circumferential surface 30*b*. Each of the plurality of second grooves 31*b* has a similar configuration, for example. Second grooves 31*b* are spaced from one another in the circumferential direction of second heat transfer tube 3*b*. Each second groove 31*b* is provided in spiral form with respect to central axis O of second heat transfer tube 3*b*. Each second groove 31*b* intersects the radial direction of second heat transfer tube 3*b*. Each second groove 31*b* is provided such that its width in the circumferential direction decreases toward the outer circumference of second heat transfer tube 3*b* in the radial direction, for example.

As shown in FIG. 3, the number of first grooves 31*a* is defined as the number of first grooves 31 arranged side by side in the circumferential direction in a cross section perpendicular to the axial direction of first heat transfer tube 3*a*. As shown in FIG. 4, the number of second grooves 31*b* is defined as the number of second grooves 31*b* arranged side by side in the circumferential direction in a cross section perpendicular to the axial direction of second heat transfer tube 3*b*. The number of first grooves 31*a* is less than the number of second grooves 31*b*. Stated another way, the width of each first groove 31*a* in the circumferential direction is greater than the width of each second groove 31*b* in the circumferential direction.

The depth of each first groove 31*a* (described later in detail) is equal to the depth of each second groove 31*b*, for example. The lead angle of each first groove 31*a* (described later in detail) is equal to the lead angle of each second groove 31*b*, for example. The tube thickness of each first heat transfer tube 3*a* (described later in detail) is equal to the tube thickness of each second heat transfer tube 3*b*, for example.

Figure 5:
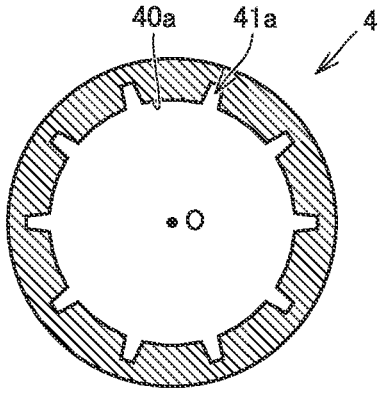
FIG. 5 is a cross-sectional view showing a third heat transfer tube of the heat exchanger shown in FIG. 2.

As shown in FIG. 5, each third heat transfer tube 4 has a third inner circumferential surface 40 and a plurality of third grooves 41, for example. Third inner circumferential surface 40 is a surface that makes contact with the refrigerant flowing through third heat transfer tube 4. Each third groove 41 is recessed relative to third inner circumferential surface 40. Each of the plurality of third grooves 41 has a similar configuration, for example. Third grooves 41 are spaced from one another in the circumferential direction of third heat transfer tube 4. Each third groove 41 is provided in spiral form with respect to central axis O of third heat transfer tube 4. Each third groove 41 intersects the radial direction of third heat transfer tube 4. Each third groove 41 is provided such that its width in the circumferential direction decreases toward the outer circumference of third heat transfer tube 4 in the radial direction, for example.

The number of third grooves 41 is defined as the number of third grooves 41 arranged side by side in the circumferential direction in a cross section perpendicular to the axial direction of third heat transfer tube 4. As described above, preferably, the internal pressure loss of the plurality of first heat transfer tubes 3*a* is greater than the internal pressure loss of the plurality of third heat transfer tubes 4. Preferably, the number of first grooves 31*a* is higher than the number of third grooves 41. Stated another way, preferably, the width of each third groove 41 in the circumferential direction is greater than the width of each first groove 31*a* in the circumferential direction.

<Flow of Refrigerant Through First Heat Exchanger 1>

When refrigeration cycle apparatus 100 is in the first state, first heat exchanger 1 serves as a condenser. In this case, first inflow/outflow portion 6*a* and second inflow/outflow portion 6*b* are connected in parallel with each other with respect to the discharge port of compressor 101. Thus, some of the refrigerant discharged from compressor 101 flows into the first refrigerant flow path through first inflow/outflow portion 6*a*, and the rest of the refrigerant flows into the second refrigerant flow path through second inflow/outflow portion 6*b*. The refrigerant that has flowed into the first refrigerant flow path exchanges heat with air and condenses while flowing through first heat transfer tubes 3*a*, to gradually decrease in its degree of dryness. The refrigerant that has flowed into the second refrigerant flow path exchanges heat with air and condenses while flowing through second heat transfer tubes 3*b*, to gradually decrease in its degree of dryness. The refrigerants that have flowed through the first refrigerant flow path and the second refrigerant flow path merge at distributor 10 and flow into the third refrigerant flow path. The refrigerant that has flowed into the third refrigerant flow path exchanges heat with air and condenses while flowing through third heat transfer tubes 4, to further decrease in its degree of dryness. The refrigerant that has flowed through the third refrigerant flow path flows out of first heat exchanger 1 through third inflow/outflow portion 5, and flows into decompression unit 103.

When refrigeration cycle apparatus 100 is in the second state, first heat exchanger 1 serves as an evaporator. In this case, all of the refrigerant decompressed in decompression unit 103 flows into the third refrigerant flow path through third inflow/outflow portion 5. The refrigerant that has flowed into the third refrigerant flow path exchanges heat with air and evaporates while flowing through third tube portions 3, to gradually increase in its degree of dryness. The gas-liquid two-phase refrigerant that has flowed through the third refrigerant flow path is branched at distributor 10 so that some of the refrigerant flows into the first refrigerant flow path, and the rest of the refrigerant flows into the second refrigerant flow path. The gas-liquid two-phase refrigerant that has flowed into the first refrigerant flow path exchanges heat with air and further evaporates while flowing through first heat transfer tubes 3*a*, to further increase in the degree of dryness. The gas-liquid two-phase refrigerant that has flowed into the second refrigerant flow path exchanges heat with air and further evaporates while flowing through second heat transfer tubes 3*b*, to further increase in the degree of dryness. The refrigerant that has flowed through each of the first refrigerant flow path and the second refrigerant flow path flows out of first heat exchanger 1 through first inflow/outflow portion 6*a* and second inflow/outflow portion 6*b*, and flows into the suction port of compressor 101.

<Performance of Distribution of Gas-Liquid Two-Phase Refrigerant in First Heat Exchanger 1>

In gas-liquid two-phase refrigerant, the specific gravity of gas-phase refrigerant is lower than the specific gravity of liquid-phase refrigerant. Therefore, if distributor 10 distributes gas-liquid two-phase refrigerant to the first refrigerant flow path disposed relatively above and the second refrigerant flow path disposed relatively below, and the internal pressure loss of the heat transfer tubes forming the first refrigerant flow path is equal to the internal pressure loss of the heat transfer tubes forming the second refrigerant flow path, the gas-phase refrigerant in the gas-liquid two-phase refrigerant flows in a greater amount through the second refrigerant flow path than through the first refrigerant flow path, and the liquid-phase refrigerant flows in a greater amount through the second refrigerant flow path than through the first refrigerant flow path. Accordingly, in the refrigerant flow path disposed above, the flow rate of the liquid-phase refrigerant becomes too low with respect to heat exchange capacity, resulting in an increased degree of overheating at the outlet. In the refrigerant flow path disposed below, on the other hand, the flow rate of the liquid-phase refrigerant becomes too high with respect to heat exchange capacity, resulting in the liquid-phase refrigerant flowing out without completely evaporating. As a result, such a heat exchanger has reduced performance.

In contrast, in first heat exchanger 1, the internal pressure loss of first heat transfer tubes 3*a* forming the first refrigerant flow path disposed above is smaller than the internal pressure loss of second heat transfer tubes 3*b* forming the second refrigerant flow path disposed below the first refrigerant flow path. In first heat exchanger 1, therefore, the difference in flow rate between the liquid-phase refrigerants flowing through first heat transfer tubes 3*a* and second heat transfer tubes 3*b* is reduced compared to that of the conventional heat exchanger described above. As a result, first heat exchanger 1 has improved heat exchange performance compared to that of the conventional heat exchanger described above.

Further, in first heat exchanger 1, because the number of first grooves 31*a* is less than the number of second grooves 31*b*, the internal pressure loss of first heat transfer tube 3*a* is set to be smaller than the internal pressure loss of second heat transfer tube 3*b*. In other words, the internal pressure loss of first heat transfer tube 3*a* is set to be smaller than the internal pressure loss of second heat transfer tube 3*b*, while first heat transfer tube 3*a* has an outer diameter equal to that of second heat transfer tube 3*b*, and each through hole in fin 2 through which each of first heat transfer tube 3*a* and second heat transfer tube 3*b* is inserted has a constant diameter. Thus, first heat exchanger 1 is readily assembled as compared to, for example, a heat exchanger in which the outer diameter and inner diameter of a heat transfer tube are varied with location in order to reduce pressure loss.

<Pressure Loss of Refrigerant in First Heat Exchanger 1>

Pressure loss of refrigerant increases with an increase in specific volume of the refrigerant, and with an increase in flow rate of the refrigerant. Further, pressure loss of refrigerant increases with an increase in flow path resistance of a heat transfer tube through which the refrigerant flows.

In the first state, the refrigerant that has been discharged from compressor 101 and having a high degree of dryness flows into first heat transfer tube 3*a* and second heat transfer tube 3*b*, and the refrigerant that has condensed in first heat transfer tube 3*a* and second heat transfer tube 3*b* and having a reduced degree of dryness flows into third heat transfer tube 4. Thus, the specific volume of the refrigerant flowing through each of first heat transfer tube 3*a* and second heat transfer tube 3*b* is higher than the specific volume of the refrigerant flowing through each third heat transfer tube 4. Further, because the number of each of first grooves 31*a* and second grooves 31*b* is higher than the number of third grooves 41, the flow path resistance of each of first heat transfer tube 3*a* and second heat transfer tube 3*b* is higher than the flow path resistance of third heat transfer tube 4. On the other hand, the flow rate of the refrigerant flowing through each of first heat transfer tube 3*a* and second heat transfer tube 3*b* is lower than, for example, about one-half of, the flow rate of the refrigerant flowing through each third heat transfer tube 4.

In other words, the specific volume of the refrigerant flowing through each of first heat transfer tube 3*a* and second heat transfer tube 3*b* and the flow path resistances of first heat transfer tube 3*a* and second heat transfer tube 3*b* caused by first grooves 31*a* and second grooves 31*b* are higher than the specific volume of the refrigerant flowing through each third heat transfer tube 4 and the flow path resistance of each third heat transfer tube 4 caused by third grooves 41. In contrast, the flow rate through each of first heat transfer tube 3*a* and second heat transfer tube 3*b* is lower than the flow rate through each third heat transfer tube 4. Thus, increase in pressure loss of the refrigerant in first heat transfer tube 3*a* and second heat transfer tube 3*b* is suppressed.

On the other hand, the flow rate through each third heat transfer tube 4 is higher than the flow rate through each of first heat transfer tube 3*a* and second heat transfer tube 3*b*. In contrast, the specific volume of the refrigerant flowing through each third heat transfer tube 4 and the flow path resistance of each third heat transfer tube 4 caused by third grooves 41 are lower than the specific volume of the refrigerant flowing through each of first heat transfer tube 3*a* and second heat transfer tube 3*b* and the flow path resistances of first heat transfer tube 3*a* and second heat transfer tube 3*b* caused by first grooves 31*a* and second grooves 31*b*. Thus, increase in pressure loss of the refrigerant in each third heat transfer tube 4 is suppressed.

In the second state, the refrigerant that has been decompressed in decompression unit 103 and having a low degree of dryness flows into third heat transfer tube 4. The refrigerant that has evaporated in third heat transfer tube 4 and having an increased degree of dryness is branched at distributor 10 into first heat transfer tube 3*a* and second heat transfer tube 3*b*. Thus, while the flow rate of the refrigerant through each third heat transfer tube 4 is higher than the flow rate of the refrigerant through each of first heat transfer tube 3*a* and second heat transfer tube 3*b*, the specific volume of the refrigerant flowing through each third heat transfer tube 4 is lower than the specific volume of the refrigerant flowing through each of first heat transfer tube 3*a* and second heat transfer tube 3*b*. Further, because the number of third grooves 41 is lower than the number of each of first grooves 31*a* and second grooves 31*b*, the flow path resistance of third heat transfer tube 4 is lower than the flow path resistance of each of first heat transfer tube 3*a* and second heat transfer tube 3*b*.

In other words, the flow rate through each third heat transfer tube 4 is lower than the flow rate through each of first heat transfer tube 3*a* and second heat transfer tube 3*b*. In contrast, the specific volume of the refrigerant flowing through each third heat transfer tube 4 and the flow path resistance of each third heat transfer tube 4 caused by third grooves 41 are lower than the specific volume of the refrigerant flowing through each of first heat transfer tube 3*a* and second heat transfer tube 3*b* and the flow path resistance of each of first heat transfer tube 3*a* and second heat transfer tube 3*b* caused by first grooves 31*a* and second grooves 31*b*. Thus, increase in pressure loss of the refrigerant in each third heat transfer tube 4 is suppressed.

On the other hand, the flow path resistance of each of first heat transfer tube 3*a* and second heat transfer tube 3*b* is higher than the flow path resistance of third heat transfer tube 4. In contrast, the flow rate through each of first heat transfer tribe 3*a* and second heat transfer tube 3*b* is lower than the flow rate through each third heat transfer tube 4. Thus, increase in pressure loss of the refrigerant in each of first heat transfer tube 3*a* and second heat transfer tube 3*b* is suppressed.

In this manner, in the first state and the second state, the pressure loss of the refrigerant in entire first heat exchanger 1 is kept relatively low. In particular, the pressure loss of the refrigerant in entire first heat exchanger 1 is kept lower than the pressure loss of the refrigerant in the entire heat exchanger in which the entire heat transfer tube is a grooved tube similar to second heat transfer tube 3*b*.

In other words, in first heat exchanger 1, reduction in heat exchange performance is suppressed in the entire heat exchanger, while pressure loss of the refrigerant is reduced in the entire heat exchanger, as compared to a conventional heat exchanger.

By including first heat exchanger 1 described above, refrigeration cycle apparatus 100 is more efficient than a conventional refrigeration cycle apparatus.

Second Embodiment

A refrigeration cycle apparatus and a first heat exchanger according to a second embodiment basically have similar configurations to refrigeration cycle apparatus 100 and first heat exchanger 1 according to the first embodiment, but are different in that the depth of each first groove 31*a* is less than the depth of each second groove 31*b*.

In the first heat exchanger according to the second embodiment, the number of first grooves 31*a* in the cross section perpendicular to the axial direction of first heat transfer tube 3*a* is equal to the number of second grooves 31*b* in the cross section perpendicular to the axial direction of second heat transfer tube 3*b*, for example.

Figure 6:
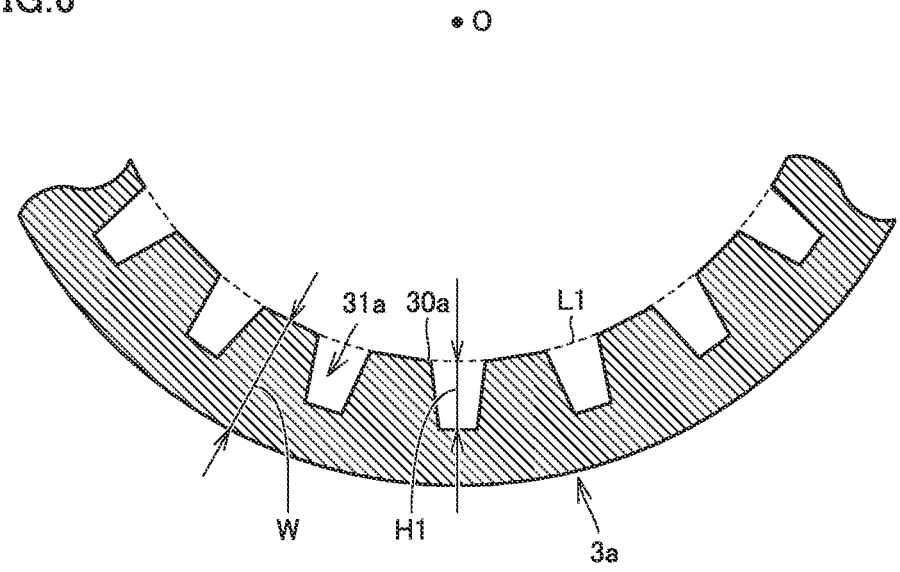
FIG. 6 is a cross-sectional view showing a first heat transfer tube of a heat exchanger according to a second embodiment.
Figure 7:
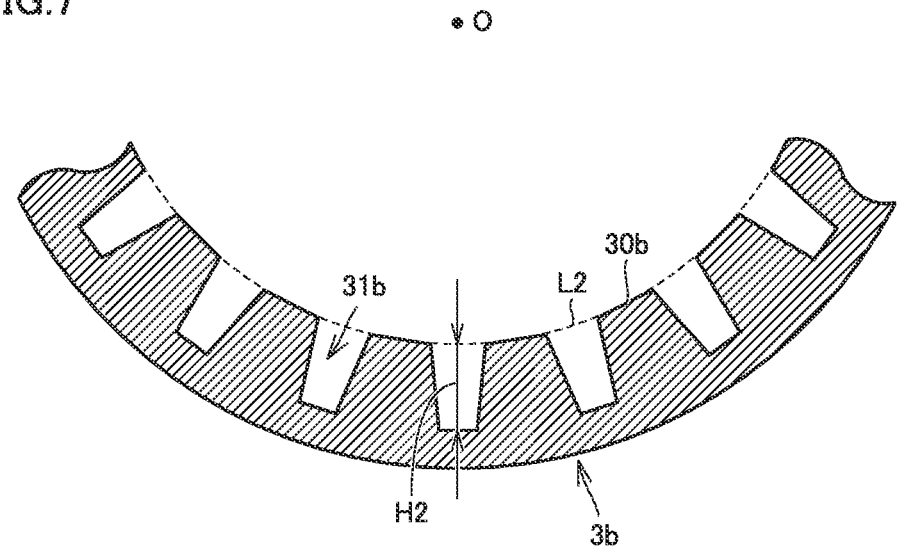
FIG. 7 is a cross-sectional view showing a second heat transfer tube of the heat exchanger according to the second embodiment.

As shown in FIG. 6, a depth H1 of first groove 31*a* is defined as the distance between an imaginary line L1 extended from first inner circumferential surface 30*a* and an inner surface of first groove 31*a*, at the center of first groove 31*a* in the circumferential direction. Depth H1 of each first groove 31*a* is equal. As shown in FIG. 7, a depth H2 of second groove 31*b* is defined as the distance between an imaginary line L2 extended from second inner circumferential surface 30*b* and an inner surface of second groove 31*b*, at the center of second groove 31*b* in the circumferential direction. Depth H2 of each second groove 31*b* is equal.

In the first heat exchanger according to the second embodiment, depth H1 of each first groove 31*a* is less than depth H2 of each second groove 31*b*. The area of the inner surfaces of first grooves 31*a* is less than the area of the inner surfaces of second grooves 31*b*. Thus, as in first heat exchanger 1 according to the first embodiment, also in the first heat exchanger according to the second embodiment, the internal pressure loss of first heat transfer tube 3*a* is smaller than the internal pressure loss of second heat transfer tube 3*b*, and the difference in flow rate between the liquid-phase refrigerants flowing through first heat transfer tube 3*a* and second heat transfer tube 3*b* is reduced compared to that of the conventional heat exchanger described above. As a result, the first heat exchanger according to the second embodiment also has improved heat exchange performance compared to that of the conventional heat exchanger described above.

The depth of each third groove is less than depth H1 of each first groove 31*a*. The flow path resistance of first heat transfer tube 3*a* is higher than the flow path resistance of third heat transfer tube 4. Thus, the pressure loss of the refrigerant in the entire first heat exchanger according to the second embodiment is kept lower than the pressure loss of the refrigerant in the entire heat exchanger in which the entire heat transfer tube is a grooved tube similar to second heat transfer tube 3*b*.

In this manner, the first heat exchanger according to the second embodiment can produce similar effects to those of first heat exchanger 1 according to the first embodiment.

As in first heat exchanger 1 according to the first embodiment, also in the first heat exchanger according to the second embodiment, the number of first grooves 31*a* in the cross section perpendicular to the axial direction of first heat transfer tube 3*a* may be less than the number of second grooves 31*b* in the cross section perpendicular to the axial direction of second heat transfer tube 3*b*, for example. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the numbers and the depths of first grooves 31*a* and second grooves 31*b*. Therefore, even when it is difficult to design the difference in internal pressure loss only by the difference in one of the two parameters, for example, the difference in internal pressure loss is relatively readily achieved.

Third Embodiment

A refrigeration cycle apparatus and a first heat exchanger according to a third embodiment basically have similar configurations to refrigeration cycle apparatus 100 and first heat exchanger 1 according to the first embodiment, but are different in that the lead angle of each first groove 31*a* is less than the lead angle of each second groove 31*b*.

In the first heat exchanger according to the third embodiment, the number of first grooves 31*a* in the cross section perpendicular to the axial direction of first heat transfer tube 3*a* is equal to the number of second grooves 31*b* in the cross section perpendicular to the axial direction of second heat transfer tube 3*b*, for example. In addition, in the first heat exchanger according to the third embodiment, depth H1 of each first groove 31*a* is equal to depth H2 of each second groove 31*b*, for example.

Figure 8:
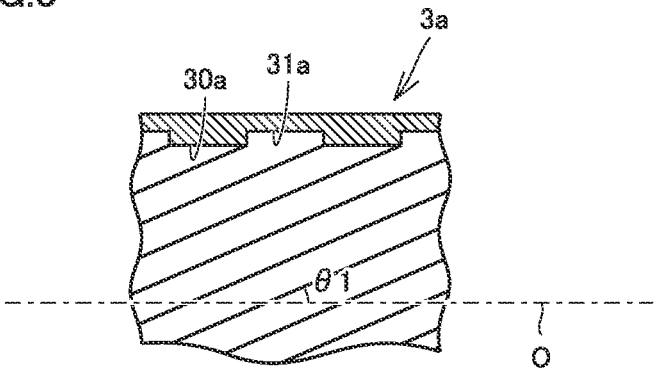
FIG. 8 is a cross-sectional view showing a first heat transfer tube of a heat exchanger according to a third embodiment.

As shown in FIG. 8, a lead angle θ1 of first groove 31*a* is defined as the angle formed by a direction in which first groove 31*a* extends with respect to central axis O of first heat transfer tube 3*a*. Lead angle θ1 of each first groove 31*a* is equal.

Figure 9:
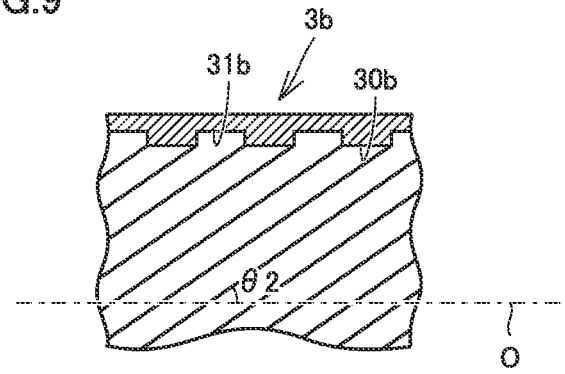
FIG. 9 is a cross-sectional view showing a second heat transfer tube of the heat exchanger according to the third embodiment.

As shown in FIG. 9, a lead angle θ2 of second groove 31*b* is defined as the angle formed by a direction in which second groove 31*b* extends with respect to central axis O of second heat transfer tube 3*b*. Lead angle θ2 of each second groove 31*b* is equal.

In the first heat exchanger according to the third embodiment, lead angle θ1 of each first groove 31*a* is less than lead angle θ2 of each second groove 31*b*. The length of each such first groove 31*a* in the extension direction is less than the length of each second groove 31*b* in the extension direction. Thus, when the number and the depth of first grooves 31*a* are equal to or less than the number and the depth of second grooves 31*b*, the area of the inner surfaces of first grooves 31*a* is less than the area of the inner surfaces of second grooves 31*b*. Thus, as in first heat exchanger 1 according to the first embodiment, also in the first heat exchanger according to the third embodiment, the internal pressure loss of first heat transfer tube 3*a* is smaller than the internal pressure loss of second heat transfer tube 3*b*, and the difference in flow rate between the liquid-phase refrigerants flowing through first heat transfer tube 3*a* and second heat transfer tube 3*b* is reduced compared to that of the conventional heat exchanger described above. As a result, the first heat exchanger according to the third embodiment also has improved heat exchange performance compared to that of the conventional heat exchanger described above.

The lead angle of each third groove is less than lead angle θ1 of each first groove 31*a*. Thus, the flow path resistance of first heat transfer tube 3*a* is higher than the flow path resistance of third heat transfer tube 4. Thus, the pressure loss of the refrigerant in the entire first heat exchanger according to the third embodiment is kept lower than the pressure loss of the refrigerant in the entire heat exchanger in which the entire heat transfer tube is a grooved tube similar to second heat transfer tube 3*b*.

In this manner, the first heat exchanger according to the third embodiment can produce similar effects to those of first heat exchanger 1 according to the first embodiment.

As in first heat exchanger 1 according to the first embodiment, also in the first heat exchanger according to the third embodiment, the number of first grooves 31*a* in the cross section perpendicular to the axial direction of first heat transfer tube 3*a* may be less than the number of second grooves 31*b* in the cross section perpendicular to the axial direction of second heat transfer tube 3*b*, for example. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the numbers and the lead angles of first grooves 31*a* and second grooves 31*b*. Therefore, even when it is difficult to design the difference in internal pressure loss only by the difference in one of the two parameters, for example, the difference in internal pressure loss is relatively readily achieved.

As in first heat exchanger 1 according to the second embodiment, also in the first heat exchanger according to the third embodiment, depth H1 of each first groove 31*a* may be less than depth H2 of each second groove 31*b*. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the depths and the lead angles of first grooves 31*a* and second grooves 31*b*. Therefore, even when it is difficult to design the difference in internal pressure loss only by the difference in one of the two parameters, for example, the difference in internal pressure loss is relatively readily achieved.

Fourth Embodiment

A refrigeration cycle apparatus and a first heat exchanger according to a fourth embodiment basically have similar configurations to refrigeration cycle apparatus 100 and first heat exchanger 1 according to the first embodiment, but are different in that the tube thickness of each first heat transfer tube 3*a* is less than the tube thickness of each second heat transfer tube 3*b*.

First heat transfer tube 3*a* has an outer diameter equal to that of second heat transfer tube 3*b*. The number of first grooves 31*a* in the cross section perpendicular to the axial direction of first heat transfer tube 3*a* is equal to the number of second grooves 31*b* in the cross section perpendicular to the axial direction of second heat transfer tube 3*b*, for example. In the first heat exchanger according to the fourth embodiment, depth H1 of each first groove 31*a* is equal to depth H2 of each second groove 31*b*, for example. In the first heat exchanger according to the fourth embodiment, lead angle θ1 of each first groove 31*a* is equal to lead angle θ2 of each second groove 31*b*, for example.

Figure 10:
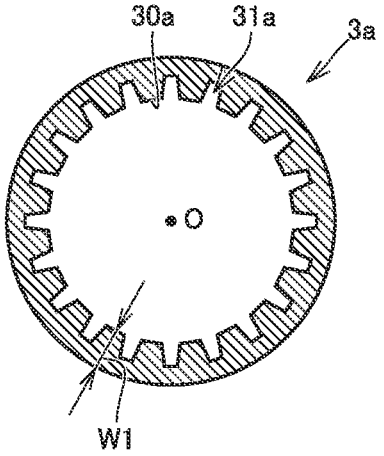
FIG. 10 is a cross-sectional view showing a first heat transfer tube of a heat exchanger according to a fourth embodiment.

As shown in FIG. 10, a tube thickness W1 of first heat transfer tube 3*a* is defined as the thickness between first inner circumferential surface 30*a* and an outer circumferential surface of first heat transfer tube 3*a*, that is, the distance between first inner circumferential surface 30*a* and the outer circumferential surface of first heat transfer tube 3*a* in the radial direction of first heat transfer tube 3*a*. Tube thickness W1 of each first heat transfer tube 3*a* is equal.

Figure 11:
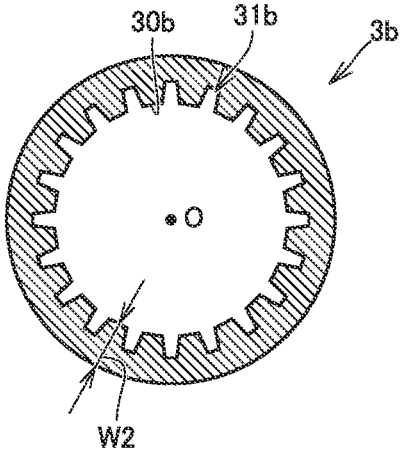
FIG. 11 is a cross-sectional view showing a second heat transfer tube of the heat exchanger according to the fourth embodiment.

As shown in FIG. 11, a tube thickness W2 of second heat transfer tube 3*b* is defined as the thickness between second inner circumferential surface 30*b* and an outer circumferential surface of second heat transfer tube 3*b*, that is, the distance between second inner circumferential surface 30*b* and the outer circumferential surface of second heat transfer tube 3*b* in the radial direction of second heat transfer tube 3*b*. Tube thickness W2 of each second heat transfer tube 3*b* is equal.

In the first heat exchanger according to the fourth embodiment, tube thickness W1 of each first heat transfer tube 3*a* is smaller than tube thickness W2 of each second heat transfer tube 3*b*. Also in this case, because first heat transfer tube 3*a* has an outer diameter equal to that of second heat transfer tube 3*b*, an internal flow path cross-sectional area of first heat transfer tube 3*a* is less than an internal flow path cross-sectional area of second heat transfer tube 3*b*. Thus, as in first heat exchanger 1 according to the first embodiment, also in the first heat exchanger according to the fourth embodiment, the internal pressure loss of first heat transfer tube 3*a* is smaller than the internal pressure loss of second heat transfer tube 3*b*, and the difference in flow rate between the liquid-phase refrigerants flowing through first heat transfer tube 3*a* and second heat transfer tube 3*b* is reduced compared to that of the conventional heat exchanger described above. As a result, the first heat exchanger according to the fourth embodiment also has improved heat exchange performance compared to that of the conventional heat exchanger described above.

The tube thickness of third heat transfer tube 4 is less than tube thickness W1 of first heat transfer tube 3*a*. Third heat transfer tube 4 has an outer diameter equal to that of first heat transfer tube 3*a*. Thus, the internal pressure loss of first heat transfer tube 3*a* is higher than the internal pressure loss of third heat transfer tube 4. As a result, the pressure loss of the refrigerant in the entire first heat exchanger according to the fourth embodiment is kept lower than the pressure loss of the refrigerant in the entire heat exchanger in which the entire heat transfer tube is a grooved tube similar to second heat transfer tube 3*b*.

In this manner, the first heat exchanger according to the fourth embodiment can produce similar effects to those of first heat exchanger 1 according to the first embodiment.

As in first heat exchanger 1 according to the first embodiment, also in the first heat exchanger according to the fourth embodiment, the number of first grooves 31*a* in the cross section perpendicular to the axial direction of first heat transfer tube 3*a* may be less than the number of second grooves 31*b* in the cross section perpendicular to the axial direction of second heat transfer tube 3*b*, for example. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the numbers of first grooves 31*a* and second grooves 31*b*, and the tube thicknesses of first heat transfer tube 3*a* and second heat transfer tube 3*b*. Therefore, even when it is difficult to design the difference in internal pressure loss only by the difference in one of the two parameters, for example, the difference in internal pressure loss is relatively readily achieved.

As in first heat exchanger 1 according to the second embodiment, also in the first heat exchanger according to the fourth embodiment, depth H1 of each first groove 31*a* may be less than depth H2 of each second groove 31*b*. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the depths of first groove 31*a* and second groove 31*b*, and the tube thicknesses of first heat transfer tube 3*a* and second heat transfer tube 3*b*. Therefore, even when it is difficult to design the difference in internal pressure loss only by the difference in one of the two parameters, for example, the difference in internal pressure loss is relatively readily achieved.

As in first heat exchanger 1 according to the third embodiment, also in the first heat exchanger according to the fourth embodiment, lead angle θ1 of each first groove 31*a* may be less than lead angle θ2 of each second groove 31*b*. In such a first heat exchanger, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of two parameters, which are the lead angles of first groove 31*a* and second groove 31*b*, and the tube thicknesses of first heat transfer tube 3*a* and second heat transfer tube 3*b*. Therefore, even when it is difficult to design the difference in internal pressure loss only by the difference in one of the two parameters, for example, the difference in internal pressure loss is relatively readily achieved.

Fifth Embodiment

A refrigeration cycle apparatus and a first heat exchanger according to a fifth embodiment basically have similar configurations to refrigeration cycle apparatus 100 and first heat exchanger 1 according to the first embodiment, but are different in that the number of first grooves 31*a* is less than the number of second grooves 31*b*, that depth H1 of each first groove 31*a* is less than depth H2 of each second groove 31*b*, that lead angle θ1 of each first groove 31*a* is less than lead angle θ2 of each second groove 31*b*, and that tube thickness W1 of each first heat transfer tube 3*a* is less than tube thickness W2 of each second heat transfer tube 3*b*.

The first heat exchanger according to the fifth embodiment also basically has a similar configuration to the first heat exchangers according to the first to fourth embodiments described above, and can therefore produce similar effects to those of the first heat exchangers according to the first to fourth embodiments.

In addition, in the first heat exchanger according to the fifth embodiment, the difference in internal pressure loss between first heat transfer tube 3*a* and second heat transfer tube 3*b* that is required to reduce the difference in flow rate between the liquid-phase refrigerants flowing through first heat transfer tube 3*a* and second heat transfer tube 3*b* is designed by the difference in each of four parameters, which are the numbers, the depths, and the lead angles of first grooves 31*a* and second grooves 31*b*, and the tube thicknesses of first heat transfer tube 3*a* and second heat transfer tube 3*b*. Therefore, even when it is difficult to design the difference in internal pressure loss only by the differences in three of the four parameters, for example, the difference in internal pressure loss is relatively readily achieved.

As described above, in the first heat exchangers according to the first to fifth embodiments, at least one of the number, the depth, and the lead angle of the plurality of first grooves 31*a*, and the tube thickness of the plurality of first heat transfer tubes 3*a* is less than at least one of the number, the depth, and the lead angle of the plurality of second grooves 31*b*, and the tube thickness of the plurality of second heat transfer tubes 3*b*.

In addition, in the first heat exchangers according to the first to fifth embodiments, at least one of the number, the depth, and the lead angle of the plurality of first grooves 31*a*, and the tube thickness of the plurality of first heat transfer tubes 3*a* exceeds at least one of the number, the depth, and the lead angle of the plurality of third grooves 41, and the tube thickness of the plurality of third heat transfer tubes 4.

Sixth Embodiment

A refrigeration cycle apparatus and a first heat exchanger according to a sixth embodiment basically have similar configurations to refrigeration cycle apparatus 100 and first heat exchanger 1 according to the first embodiment, but are different in further including a plurality of fourth heat transfer tubes 3*c* and a plurality of fifth heat transfer tubes 3*d* connected in parallel with the plurality of first heat transfer tubes 3*a* and the plurality of second heat transfer tubes 3*b*.

Each of the plurality of fourth heat transfer tubes 3*c* is disposed above each of the plurality of third heat transfer tubes 4 and below each of the plurality of second heat transfer tubes 3*b*, for example. In other words, in the second state in which first heat exchanger 1 serves as an evaporator, a flow inlet through which the refrigerant flows into each fourth heat transfer tube 3*c* is disposed above the flow inlet through which the refrigerant flows into each third heat transfer tube 4 and below the flow inlet through which the refrigerant flows into each second heat transfer tube 3*b*.

Each of the plurality of fifth heat transfer tubes 3*d* is disposed above each of the plurality of third heat transfer tubes 4 and below each of the plurality of fourth heat transfer tubes 3*c*, for example. In other words, in the second state in which first heat exchanger 1 serves as an evaporator, a flow inlet through which the refrigerant flows into each fifth heat transfer tube 3*d* is disposed above the flow inlet through which the refrigerant flows into each third heat transfer tube 4 and below the flow inlet through which the refrigerant flows into each fourth heat transfer tube 3*c*.

Figure 12:
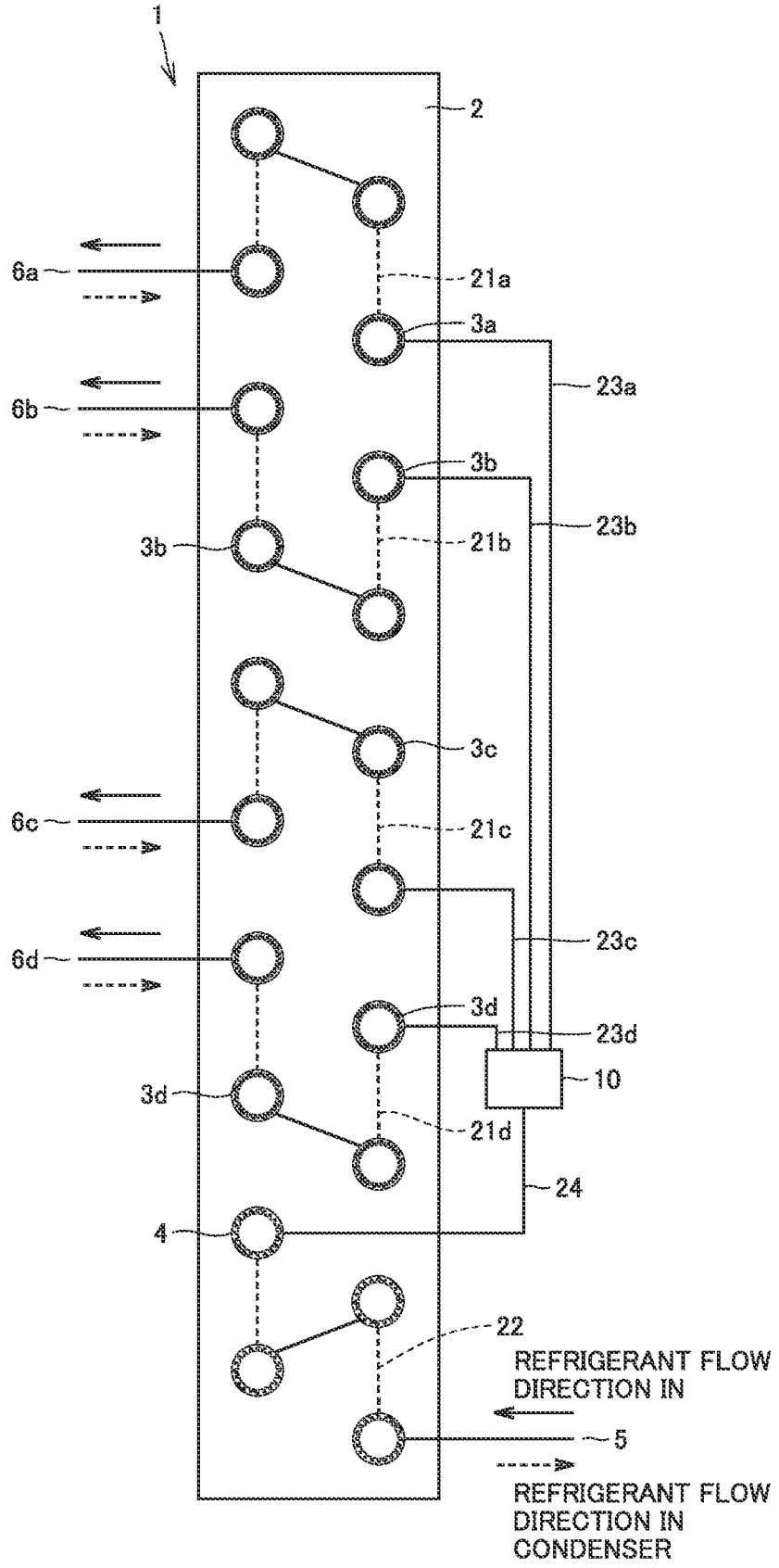
FIG. 12 is a diagram showing a heat exchanger according to a sixth embodiment.

As shown in FIG. 12, the plurality of fourth heat transfer tubes 3*c* are connected in series with one another via a seventh connection portion 21*c*. The plurality of fifth heat transfer tubes 3*d* are connected in series with one another via an eighth connection portion 21*d*.

As shown in FIG. 12, the plurality of fourth heat transfer tubes 3*c* are connected in series with distributor 10 via a ninth connection portion 23*c*. The plurality of fifth heat transfer tubes 3*d* are connected in series with distributor 10 via a tenth connection portion 23*d*. Seventh connection portion 21*c*, eighth connection portion 21*d*, ninth connection portion 23*c*, and tenth connection portion 23*d* are each configured as a connection pipe that connects two inlet/outlet ports in series. In FIG. 12, seventh connection portion 21*c* and eighth connection portion 21*d* indicated by solid lines are connected to respective one ends of the plurality of fourth heat transfer tubes 3*c* and fifth heat transfer tubes 3*d*, while seventh connection portion 21*c* and eighth connection portion 21*d* indicated by dotted lines are connected to respective other ends of the plurality of fourth heat transfer tubes 3*c* and fifth heat transfer tubes 3*d*.

As shown in FIG. 12, distributor 10 has first port P5, second port P6 and third port P7, as well as a fourth port P8 connected to fourth heat transfer tubes 3*c* via ninth connection portion 23*c*, and a fifth port P9 connected to fifth heat transfer tubes 3*d* via tenth connection portion 23*d*.

First port P5, second port P6, fourth port P8 and fifth port P9 are disposed above third port P7. Distributor 10 has the refrigerant flow path connecting first port P5 to third port P7, the refrigerant flow path connecting second port P6 to third port P7, a refrigerant flow path connecting fourth port P8 to third port P7, and a refrigerant flow path connecting fifth port P9 to third port P7. The pressure loss of each refrigerant flow path within distributor 10 is set to be equal to one another, for example.

Fourth heat transfer tubes 3*c* connected in series with one another via seventh connection portion 21*c* form a fourth refrigerant flow path. Fifth heat transfer tubes 3*d* connected in series with one another via eighth connection portion 21*d* form a fifth refrigerant flow path. The fourth refrigerant flow path is disposed above the fifth refrigerant flow path. The fifth refrigerant flow path is disposed above the third refrigerant flow path.

The first refrigerant flow path, the second refrigerant flow path, the fourth refrigerant flow path and the fifth refrigerant flow path form branched paths diverging from the third refrigerant flow path. The first refrigerant flow path, the second refrigerant flow path, the fourth refrigerant flow path and the fifth refrigerant flow path are connected in series with the third refrigerant flow path via distributor 10. First heat transfer tubes 3*a*, second heat transfer tubes 3*b*, fourth heat transfer tubes 3*c*, and fifth heat transfer tubes 3*d* are connected in parallel with one another with respect to distributor 10. First heat transfer tubes 3*a*, second heat transfer tubes 3*b*, fourth heat transfer tubes 3*c*, and fifth heat transfer tubes 3*d* are each connected in series with the plurality of third heat transfer tubes 4 via distributor 10.

The third refrigerant flow path has one end connected to decompression unit 103 via third inflow/outflow portion 5. The third refrigerant flow path has the other end connected to one end of the first refrigerant flow path, one end of the second refrigerant flow path, one end of the fourth refrigerant flow path, and one end of the fifth refrigerant flow path via distributor 10. The first refrigerant flow path has the other end connected to third opening P3 in four-way valve 102 via first inflow/outflow portion 6*a*. The second refrigerant flow path has the other end connected to third opening P3 in four-way valve 102 via second inflow/outflow portion 6*b*. The fourth refrigerant flow path has the other end connected to third opening P3 in four-way valve 102 via a fourth inflow/outflow portion 6*c*. The fifth refrigerant flow path has the other end connected to third opening P3 in four-way valve 102 via a fifth inflow/outflow portion 6*d*.

The plurality of first heat transfer tubes 3*a*, the plurality of second heat transfer tubes 3*b*, the plurality of third heat transfer tubes 4, the plurality of fourth heat transfer tubes 3*c*, and the plurality of fifth heat transfer tubes 3*d* are each configured as a circular tube.

An internal pressure loss of the plurality of fourth heat transfer tubes 3*c* is greater than the internal pressure loss of the plurality of second heat transfer tubes 3*b*, and is smaller than an internal pressure loss of the plurality of fifth heat transfer tubes 3*d*. The internal pressure loss of the plurality of fifth heat transfer tubes 3*d* is greater than the internal pressure loss of the plurality of third heat transfer tubes 4.

Each fourth heat transfer tube 3*c* has a fourth inner circumferential surface which is not shown, and a plurality of fourth grooves which are not shown. The fourth inner circumferential surface is a surface that makes contact with the refrigerant flowing through fourth heat transfer tube 3*c*. Each fourth groove is recessed relative to the fourth inner circumferential surface. Each of the plurality of fourth grooves has a similar configuration, for example. The fourth grooves are spaced from one another in the circumferential direction of fourth heat transfer tube 3*c*. Each fourth groove is provided in spiral form with respect to central axis O of fourth heat transfer tube 3*c*. Each fourth groove intersects the radial direction of fourth heat transfer tube 3*c*. Each fourth groove is provided such that its width in the circumferential direction decreases toward the outer circumference of fourth heat transfer tube 3*c* in the radial direction, for example.

Each fifth heat transfer tube 3*d* has a fifth inner circumferential surface which is not shown, and a plurality of fifth grooves which are not shown. The fifth inner circumferential surface is a surface that makes contact with the refrigerant flowing through fifth heat transfer tube 3*d*. Each fifth groove is recessed relative to the fifth inner circumferential surface. Each of the plurality of fifth grooves has a similar configuration, for example. The fifth grooves are spaced from one another in the circumferential direction of fifth heat transfer tube 3*d*. Each fifth groove is provided in spiral form with respect to central axis O of fifth heat transfer tube 3*d*. Each fifth groove intersects the radial direction of fifth heat transfer tube 3*d*. Each fifth groove is provided such that its width in the circumferential direction decreases toward the outer circumference of fifth heat transfer tube 3*d* in the radial direction, for example.

Second heat transfer tube 3*b* and fourth heat transfer tube 3*c* have a relationship with each other, and fourth heat transfer tube 3*c* and fifth heat transfer tube 3*d* have a relationship with each other, that are similar to the relationship between first heat transfer tube 3*a* and second heat transfer tube 3*b*. In other words, at least one of the number, the depth, and the lead angle of second grooves 31*b*, and the tube thickness of second heat transfer tube 3*b* is less than at least one of the number, the depth, and the lead angle of the fourth grooves, and the tube thickness of fourth heat transfer tube 3*c*. At least one of the number, the depth, and the lead angle of the fourth grooves, and the tube thickness of fourth heat transfer tube 3*c* is less than at least one of the number, the depth, and the lead angle of the fifth grooves, and the tube thickness of fifth heat transfer tube 3*d*. Note that the number, the depth, and the lead angle of each of the fourth grooves and the fifth grooves are defined similarly to the number, the depth, and the lead angle of each of first grooves 31*a* and second grooves 31*b*. The tube thickness of each of fourth heat transfer tube 3*c* and fifth heat transfer tube 3*d* is defined similarly to the tube thickness of each of first heat transfer tube 3*a* and second heat transfer tube 3*b*.

The number of second grooves 31*b* exceeds the number of first grooves 31*a*, and is less than the number of the fourth grooves, for example. That is, any one of the parameters including the number, the depth, the lead angle, and the tube thickness that satisfies the above-described relationship of magnitude between first heat transfer tube 3*a* and second heat transfer tube 3*b* is the same as a parameter that satisfies the above-described relationship of magnitude between second heat transfer tube 3*b* and fourth heat transfer tube 3*c*, for example. In other words, first heat transfer tube 3*a*, second heat transfer tube 3*b*, and fourth heat transfer tube 3*c* are provided such that any one of these parameters including the number, the depth, the lead angle, and the tube thickness satisfies the above-described two-stage relationship of magnitude, for example. The number of second grooves 31*b* may exceed the number of first grooves 31*a*, and the depth of second grooves 31*b* may be less than the depth of the plurality of fourth grooves, for example. That is, any one of the parameters including the number, the depth, the lead angle, and the tube thickness that satisfies the above-described relationship of magnitude between first heat transfer tube 3*a* and second heat transfer tube 3*b* may be different from a parameter that satisfies the above-described relationship of magnitude between second heat transfer tube 3*b* and fourth heat transfer tube 3*c*. In the above-described case, the number of second grooves 31*b* may be equal to the number of the fourth grooves. In other words, second heat transfer tube 3*b* and fourth heat transfer tube 3*c* may be provided to be equal in any one of the parameters including the number, the depth, the lead angle, and the tube thickness that satisfies the above-described relationship of magnitude between first heat transfer tube 3*a* and second heat transfer tube 3*b*.

The number of the fourth grooves exceeds the number of second grooves 31*b*, and is less than the number of the fifth grooves, for example. That is, any one of the parameters including the number, the depth, the lead angle, and the tube thickness that satisfies the above-described relationship of magnitude between second heat transfer tube 3*b* and fourth heat transfer tube 3*c* is the same as a parameter that satisfies the above-described relationship of magnitude between fourth heat transfer tube 3*c* and fifth heat transfer tube 3*d*, for example. In other words, first heat transfer tube 3*a*, second heat transfer tube 3*b*, fourth heat transfer tube 3*c*, and fifth heat transfer tube 3*d* are provided such that any one of these parameters including the number, the depth, the lead angle, and the tube thickness satisfies the above-described three-stage relationship of magnitude, for example. The number of the fourth grooves may exceed the number of second grooves 31*b*, and the depth of the fourth grooves may be less than the depth of the plurality of fifth grooves, for example. That is, any one of the parameters including the number, the depth, the lead angle, and the tube thickness that satisfies the above-described relationship of magnitude between second heat transfer tube 3*b* and fourth heat transfer tube 3*c* may be different from a parameter that satisfies the above-described relationship of magnitude between fourth heat transfer tube 3*c* and fifth heat transfer tube 3*d*. In the above-described case, the number of the fifth grooves may be equal to the number of the fourth grooves. In other words, fourth heat transfer tube 3*c* and fifth heat transfer tube 3*d* may be provided to be equal in any one of the parameters including the number, the depth, the lead angle, and the tube thickness that satisfies the above-described relationship of magnitude between second heat transfer tube 3*b* and fourth heat transfer tube 3*c*.

First heat exchanger 1 according to the sixth embodiment has a higher number of refrigerant flow paths connecting distributor 10 to third opening P3 in four-way valve 102, and therefore has a higher capacity than first heat exchanger 1 according to the first embodiment. First heat exchanger 1 according to the sixth embodiment, on the other hand, can produce similar effects to those of first heat exchanger 1 according to the first embodiment, because its first to fifth refrigerant flow paths connecting distributor 10 to third opening P3 in four-way valve 102 basically have a similar configuration to the first to third refrigerant flow paths in first heat exchanger 1 according to the first embodiment.

The refrigeration cycle apparatuses according to the first to sixth embodiments may include at least one first groove 31*a* and at least one second groove 31*b*. When the refrigeration cycle apparatuses according to the first to sixth embodiments include one second groove 31*b*, first groove 31*a* may be less than second groove 31*b* in at least one of the depth, the lead angle, and the tube thickness. Similarly, the refrigeration cycle apparatus according to the sixth embodiment may include at least one fourth groove. When the refrigeration cycle apparatus according to the sixth embodiment includes one fourth groove, second groove 31*b* may be less than the fourth groove in at least one of the depth and the lead angle.

Seventh Embodiment

Figure 13:
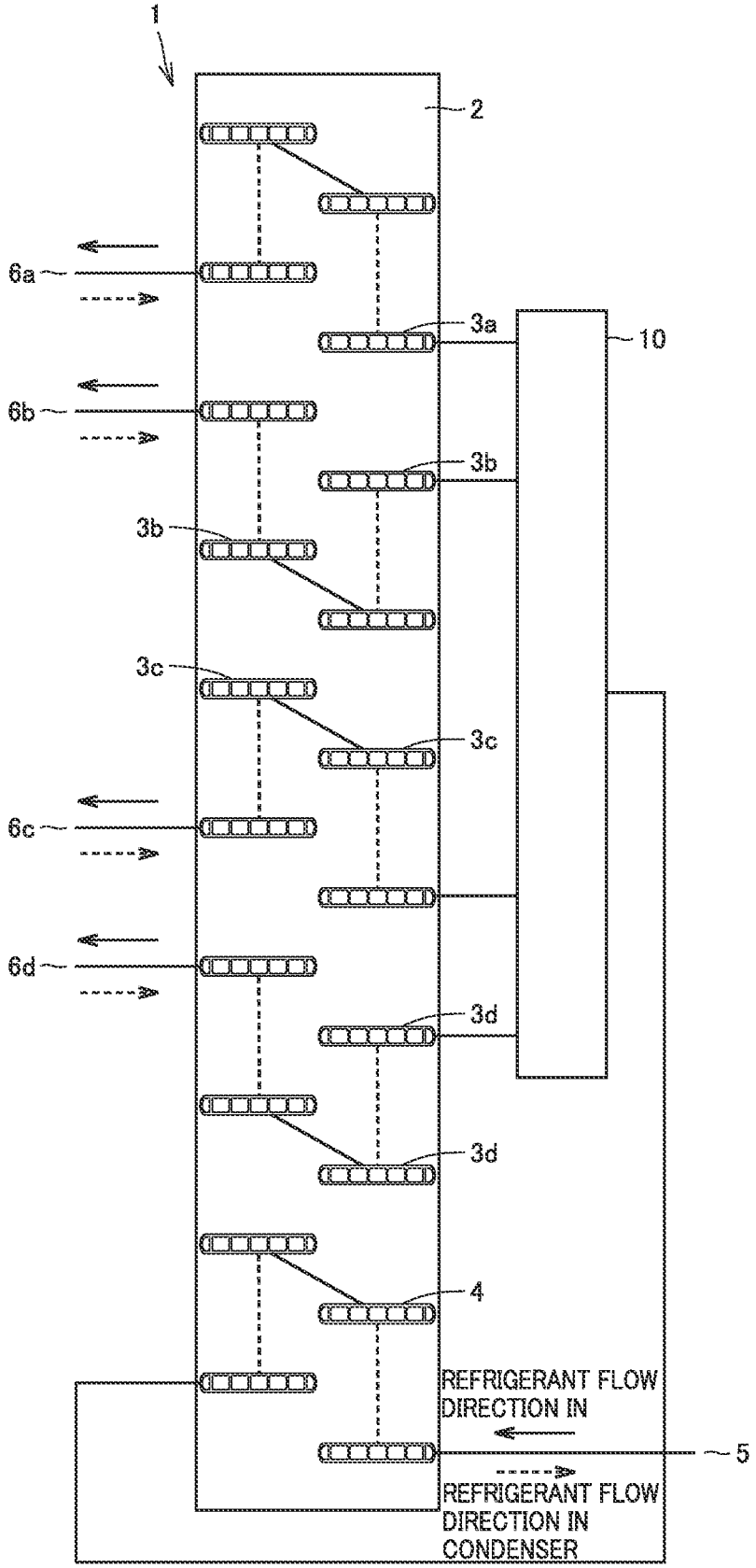
FIG. 13 is a diagram showing a heat exchanger according to a seventh embodiment.

A refrigeration cycle apparatus and a first heat exchanger according to a seventh embodiment basically have similar configurations to refrigeration cycle apparatus 100 and first heat exchanger 1 according to the first embodiment, but are different in that first heat transfer tube 3*a*, second heat transfer tube 3*b*, and third heat transfer tube 4 are each configured as a flat tube. The heat exchanger according to the seventh embodiment may have a similar configuration to any of the heat exchangers according to the second to fifth embodiments. FIG. 13 is a diagram showing the heat exchanger according to the seventh embodiment in which, as with the first heat exchanger according to the sixth embodiment, first heat transfer tubes 3*a*, second heat transfer tubes 3*b*, fourth heat transfer tubes 3*c* and fifth heat transfer tubes 3*d* are connected in parallel with one another, and first heat transfer tubes 3*a*, second heat transfer tubes 3*b*, fourth heat transfer tubes 3*c* and fifth heat transfer tubes 3*d* are each configured as a flat tube. For convenience, first heat transfer tubes 3*a*, second heat transfer tubes 3*b*, fourth heat transfer tubes 3*c* and fifth heat transfer tubes 3*d* are shown to have a similar configuration in FIG. 13.

The internal pressure loss of the plurality of first heat transfer tubes 3*a* is smaller than the internal pressure loss of the plurality of second heat transfer tubes 3*b*. The internal pressure loss of the plurality of second heat transfer tubes 3*b* is smaller than the internal pressure loss of the plurality of fourth heat transfer tubes 3*c*. The internal pressure loss of the plurality of fourth heat transfer tubes 3*c* is smaller than the internal pressure loss of the plurality of fifth heat transfer tubes 3*d*. Preferably, the internal pressure loss of the plurality of first heat transfer tubes 3*a* is greater than the internal pressure loss of the plurality of third heat transfer tubes 4.

Figure 14:
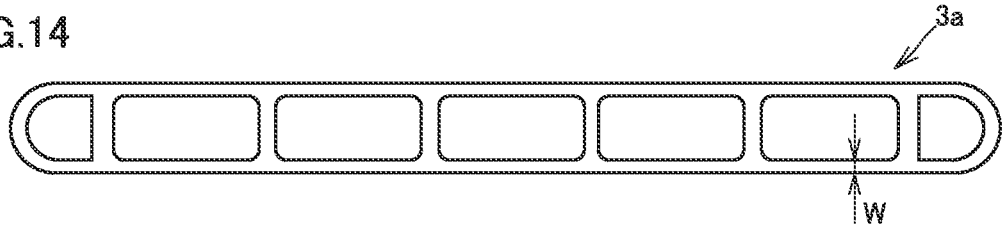
FIG. 14 is a cross-sectional view showing a first heat transfer tube of the heat exchanger shown in FIG. 13.
Figure 15:
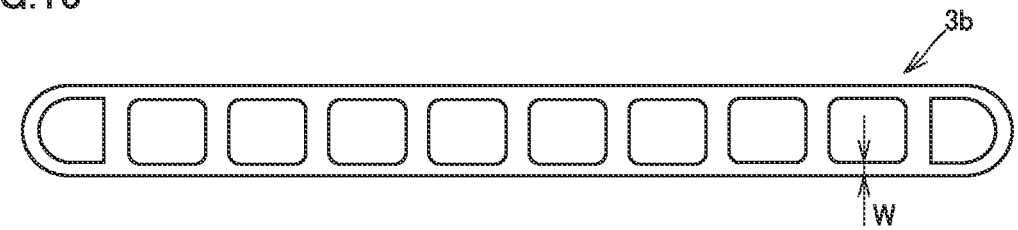
FIG. 15 is a cross-sectional view showing a second heat transfer tube of the heat exchanger shown in FIG. 13.

As shown in FIGS. 14 and 15, first heat transfer tube 3*a* has an outer shape identical to that of second heat transfer tube 3*b*. The number of holes in first heat transfer tube 3*a* is lower than the number of holes in second heat transfer tube 3*b*. Tube thickness W1 of first heat transfer tube 3*a* is equal to tube thickness W2 of second heat transfer tube 3*b*, for example. Also in this case, because first heat transfer tube 3*a* has an outer diameter equal to that of second heat transfer tube 3*b*, the internal pressure loss of first heat transfer tube 3*a* is smaller than the internal pressure loss of second heat transfer tube 3*b*. Thus, as in first heat exchanger 1 according to the first embodiment, also in the first heat exchanger according to seventh embodiment, the difference in flow rate between the liquid-phase refrigerants flowing through first heat transfer tube 3*a* and second heat transfer tube 3*b* is reduced compared to that of the conventional heat exchanger described above. As a result, the first heat exchanger according to the seventh embodiment also has improved heat exchange performance compared to that of the conventional heat exchanger described above.

Figure 16:
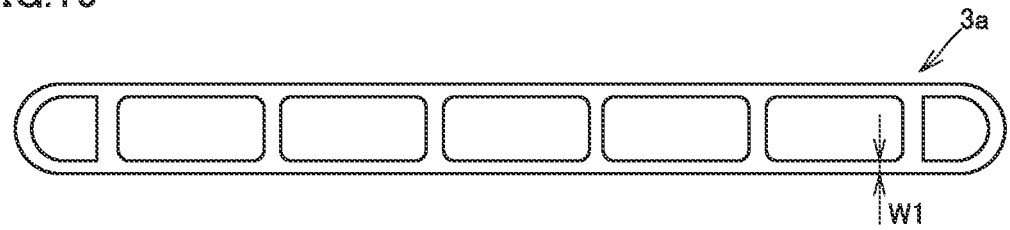
FIG. 16 is a cross-sectional view showing a variation of the first heat transfer tube of the heat exchanger according to the seventh embodiment.
Figure 17:
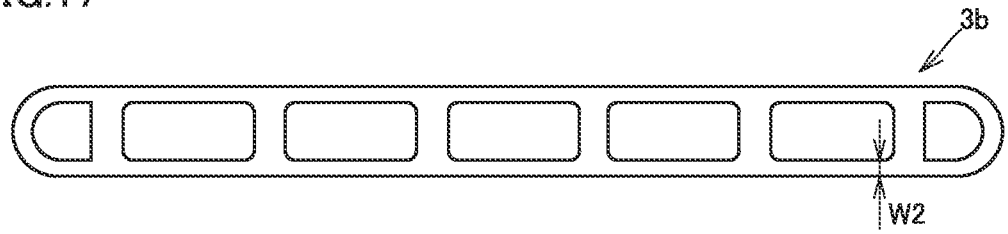
FIG. 17 is a cross-sectional view showing a variation of the second heat transfer tube of the heat exchanger according to the seventh embodiment.

As shown in FIGS. 16 and 17, in the first heat exchanger according to the seventh embodiment, tube thickness W1 of first heat transfer tube 3*a* may be smaller than tube thickness W2 of second heat transfer tube 3*b*. In this case, the number of holes in first heat transfer tube 3*a* may be equal to the number of holes in second heat transfer tube 3*b*. Also in this case, because first heat transfer tube 3*a* has an outer diameter equal to that of second heat transfer tube 3*b*, the internal pressure loss of first heat transfer tube 3*a* is smaller than the internal pressure loss of second heat transfer tube 3*b*. The number of holes in first heat transfer tube 3*a* may be lower than the number of holes in second heat transfer tube 3*b*.

The internal pressure loss of the plurality of fourth heat transfer tubes 3*c* is greater than the internal pressure loss of the plurality of second heat transfer tubes 3*b*, and is smaller than the internal pressure loss of the plurality of fifth heat transfer tubes 3*d*. The internal pressure loss of the plurality of fifth heat transfer tubes 3*d* is greater than the internal pressure loss of the plurality of third heat transfer tubes 4.

Second heat transfer tube 3*b* and fourth heat transfer tube 3*c* have a relationship with each other, and fourth heat transfer tube 3*c* and fifth heat transfer tube 3*d* have a relationship with each other, that are similar to the relationship between first heat transfer tube 3*a* and second heat transfer tube 3*b*. In other words, at least one of the number of holes in second heat transfer tube 3*b* and the tube thickness of second heat transfer tube 3*b* is less than at least one of the number of holes in fourth heat transfer tube 3*c* and the tube thickness of fourth heat transfer tube 3*c*. At least one of the number of holes in second heat transfer tube 3*b* and the tube thickness of fourth heat transfer tube 3*c* is less than at least one of the number of holes in fifth heat transfer tube 3*d* and the tube thickness of fifth heat transfer tube 3*d*.

The number of holes in second heat transfer tube 3*b* exceeds the number of holes in first heat transfer tube 3*a* and is less than the number of holes in fourth heat transfer tube 3*c*, for example. That is, any one of the parameters including the number of holes and the tube thickness that satisfies the above-described relationship of magnitude between first heat transfer tube 3*a* and second heat transfer tube 3*b* is the same as a parameter that satisfies the above-described relationship of magnitude between second heat transfer tube 3*b* and fourth heat transfer tube 3*c*, for example. In other words, first heat transfer tube 3*a*, second heat transfer tube 3*b*, and fourth heat transfer tube 3*c* are provided such that any one of these parameters including the number of holes and the tube thickness satisfies the above-described two-stage relationship of magnitude, for example. The number of holes in second heat transfer tube 3*b* may exceed the number of holes in first heat transfer tube 3*a*, and the tube thickness of second heat transfer tube 3*b* may be less than the tube thickness of fourth heat transfer tube 3*c*, for example. That is, any one of the parameters including the number of holes and the tube thickness that satisfies the above-described relationship of magnitude between first heat transfer tube 3*a* and second heat transfer tube 3*b* may be different from a parameter that satisfies the above-described relationship of magnitude between second heat transfer tube 3*b* and fourth heat transfer tube 3*c*. In the above-described case, the number of holes in second heat transfer tube 3*b* may be equal to the number of holes in fourth heat transfer tube 3*c*. In other words, second heat transfer tube 3*b* and fourth heat transfer tube 3*c* may be provided to be equal in any one of the parameters including the number of holes and the tube thickness that satisfies the above-described relationship of magnitude between first heat transfer tube 3*a* and second heat transfer tube 3*b*.

The number of holes in fourth heat transfer tube 3*c* is less than the number of holes in fifth heat transfer tube 3*d*, for example. That is, any one of the parameters including the number of holes and the tube thickness that satisfies the above-described relationship of magnitude between second heat transfer tube 3*b* and fourth heat transfer tube 3*c* is the same as a parameter that satisfies the above-described relationship of magnitude between fourth heat transfer tube 3*c* and fifth heat transfer tube 3*d*, for example. In other words, first heat transfer tube 3*a*, second heat transfer tube 3*b*, fourth heat transfer tube 3*c*, and fifth heat transfer tube 3*d* are provided such that any one of these parameters including the number of holes and the tube thickness satisfies the above-described two-stage relationship of magnitude, for example. The number of holes in fourth heat transfer tube 3*c* may exceed the number of holes in second heat transfer tube 3*b*, and the tube thickness of fourth heat transfer tube 3*c* may be less than the tube thickness of fifth heat transfer tube 3*d*, for example. That is, any one of the parameters including the number of holes and the tube thickness that satisfies the above-described relationship of magnitude between second heat transfer tube 3*b* and fourth heat transfer tube 3*c* may be different from a parameter that satisfies the above-described relationship of magnitude between fourth heat transfer tube 3*c* and fifth heat transfer tube 3*d*. In the above-described case, the number of holes in fourth heat transfer tube 3*c* may be equal to the number of holes in fifth heat transfer tube 3*d*. In other words, fourth heat transfer tube 3*c* and fifth heat transfer tube 3*d* may be provided to be equal in any one of the parameters including the number of holes and the tube thickness that satisfies the above-described relationship of magnitude between second heat transfer tube 3*b* and fourth heat transfer tube 3*c*.

In this case, the first heat exchanger according to the seventh embodiment also basically has a similar configuration to the first heat exchanger according to the sixth embodiment described above, and can therefore produce similar effects to those of the first heat exchanger according to the sixth embodiment.

Although the internal pressure loss of first heat transfer tube 3*a* is reduced compared to the internal pressure loss of second heat transfer tube 3*b* by at least one of the numbers of holes in and the tube thicknesses of first heat transfer tube 3*a* and second heat transfer tube 3*b* in the refrigeration cycle apparatus according to the seventh embodiment, this is not restrictive. First heat transfer tube 3*a* and second heat transfer tube 3*b* have first grooves 31*a* and second groove 31*b*, as with first heat transfer tube 3*a* and second heat transfer tube 3*b* in any of the first to sixth embodiments, and the internal pressure loss of first heat transfer tube 3*a* may be reduced compared to the internal pressure loss of second heat transfer tube 3*b* by at least one of the numbers, the depths, and the lead angles of these grooves.

Although the first refrigerant flow path is provided to have a flow path length equal to that of the second refrigerant flow path in the refrigeration cycle apparatuses according to the first to seventh embodiments, this is not restrictive. The first refrigerant flow path may have a flow path length different from that of the second refrigerant flow path. The first refrigerant flow path may have a flow path length shorter than that of the second refrigerant flow path, for example.

Although first heat transfer tube 3*a* is provided to have an outer shape identical to that of second heat transfer tube 3*b* in the refrigeration cycle apparatuses according to the first to seventh embodiments, this is not restrictive. First heat transfer tube 3*a* may have an outer diameter exceeding that of second heat transfer tube 3*b*, for example. Third heat transfer tube 4 may have an outer diameter exceeding that of first heat transfer tube 3*a*, for example.

In the refrigeration cycle apparatuses according to the first to seventh embodiments, second heat exchanger 11 may also have a similar configuration to first heat exchanger 1. In this case, third inflow/outflow portion 5 of second heat exchanger 11 may be connected to decompression unit 103, and first inflow/outflow portion 6*a* and second inflow/outflow portion 6*b* may be connected to fourth opening P4 in four-way valve 102.

Although the embodiments of the present invention have been described as above, the embodiments described above can be modified in various manners. In addition, the scope of the present invention is not limited to the embodiments described above. The scope of the present invention is defined by the terms of the claims, and is intended to include any modifications within the meaning and scope equivalent to the terms of the claims.

The invention claimed is:

1. A heat exchanger comprising:

a distributor; and a first heat transfer tube and a second heat transfer tube connected in parallel with each other with respect to the distributor, the first heat transfer tube being disposed above the second heat transfer tube, the first heat transfer tube having a first inner circumferential surface, and at least one first groove recessed relative to the first inner circumferential surface and arranged side by side in a circumferential direction of the first heat transfer tube, the second heat transfer tube having a second inner circumferential surface, and at least one second groove recessed relative to the second inner circumferential surface and arranged side by side in a circumferential direction of the second heat transfer tube, an internal pressure loss of the first heat transfer tube being smaller than an internal pressure loss of the second heat transfer tube, the heat exchanger further comprising a third heat transfer tube connected in series with the first heat transfer tube and the second heat transfer tube via the distributor wherein:

the internal pressure loss of the first heat transfer tube is smaller than the internal pressure loss of the second heat transfer tube, and is greater than an internal pressure loss of the third heat transfer tube, and with regard to at least one of a number, a depth, and a lead angle of each of the at least one first groove and the at least one second groove, and a tube thickness of each of the first heat transfer tube and the second heat transfer tube, at least one of the number, the depth, and the lead angle of the at least one first groove, and the tube thickness of the first heat transfer tube is smaller than at least one of the number, the depth, and the lead angle of the at least one second groove, and the tube thickness of the second heat transfer tube.

2. The heat exchanger according to claim 1, wherein the third heat transfer tube is configured as a circular tube, the third heat transfer tube has a third inner circumferential surface, and at least one third groove recessed relative to the third inner circumferential surface and arranged side by side in a circumferential direction of the third heat transfer tube, and with regard to at least one of a number, a depth, and a lead angle of each of the at least one first groove and the at least one third groove, and a tube thickness of each of the first heat transfer tube and the third heat transfer tube, at least one of the number, the depth, and the lead angle of the at least one first groove, and the tube thickness of the first heat transfer tube is greater than at least one of the number, the depth, and the lead angle of the at least one third groove, and the tube thickness of the third heat transfer tube.

3. The heat exchanger according to claim 1, wherein
the third heat transfer tube is configured as a circular tube,
the third heat transfer tube has a third inner circumferential surface, and at least one third groove recessed relative to the third inner circumferential surface and arranged side by side in a circumferential direction of the third heat transfer tube, and
with regard to at least one of a number, a depth, and a lead angle of each of the at least one first groove and the at least one third groove, and a tube thickness of each of the first heat transfer tube and the third heat transfer tube,
at least one of the number, the depth, and the lead angle of the at least one first groove, and the tube thickness of the first heat transfer tube is greater than at least one of the number, the depth, and the lead angle of the at least one third groove, and the tube thickness of the third heat transfer tube.

4. The heat exchanger according to claim 1, wherein
a first refrigerant flow path formed by the first heat transfer tube has a flow path length equal to that of a second refrigerant flow path formed by the second heat transfer tube.

5. The heat exchanger according to claim 1, wherein
the first heat transfer tube has an outer shape identical to that of the second heat transfer tube.

6. A heat exchanger comprising:
a distributor; and
a plurality of heat transfer tubes connected in parallel with each other with respect to the distributor,
the plurality of heat transfer tubes including a first heat transfer tube, and a second heat transfer tube disposed below the first heat transfer tube,
each of the first heat transfer tube and the second heat transfer tube being configured as a flat tube, and
an internal pressure loss of the first heat transfer tube being smaller than an internal pressure loss of the second heat transfer tube,
the heat exchanger further comprising a third heat transfer tube connected in series with the first heat transfer tube and the second heat transfer tube via the distributor, wherein
the internal pressure loss of the first heat transfer tube is smaller than the internal pressure loss of the second heat transfer tube, and is greater than an internal pressure loss of the third heat transfer tube.

7. The heat exchanger according to claim 6, wherein
the first heat transfer tube and the second heat transfer tube are each provided with at least one hole therein, and
the first heat transfer tube is less than the second heat transfer tube in at least one of a number of holes and a tube thickness.

8. The heat exchanger according to claim 7, wherein
the third heat transfer tube is configured as a flat tube,
the third heat transfer tube is provided with at least one hole therein, and
the third heat transfer tube is less than the first heat transfer tube in at least one of a number of holes and a tube thickness.

9. The heat exchanger according to claim 6, wherein
the third heat transfer tube is configured as a flat tube,
the third heat transfer tube is provided with at least one hole therein, and
the third heat transfer tube is less than the first heat transfer tube in at least one of a number of holes and a tube thickness.

10. The heat exchanger according to claim 6, wherein
a first refrigerant flow path formed by the first heat transfer tube has a flow path length equal to that of a second refrigerant flow path formed by the second heat transfer tube.

11. The heat exchanger according to claim 6, wherein
the first heat transfer tube has an outer shape identical to that of the second heat transfer tube.

12. A heat exchanger comprising:
a distributor;
a first heat transfer tube and a second heat transfer tube connected in parallel with each other with respect to the distributor; and
a third heat transfer tube connected in series with the first heat transfer tube and the second heat transfer tube via the distributor,
the first heat transfer tube being disposed above the second heat transfer tube, and
an internal pressure loss of the first heat transfer tube being smaller than an internal pressure loss of the second heat transfer tube, and being greater than an internal pressure loss of the third heat transfer tube.

13. The heat exchanger according to claim 12, wherein
a first refrigerant flow path formed by the first heat transfer tube has a flow path length equal to that of a second refrigerant flow path formed by the second heat transfer tube.

14. The heat exchanger according to claim 12, wherein
the first heat transfer tube has an outer shape identical to that of the second heat transfer tube.

15. A heat exchanger comprising:
a distributor; and
a first heat transfer tube and a second heat transfer tube connected in parallel with each other with respect to the distributor;
the first heat transfer tube being disposed above the second heat transfer tube,
a first refrigerant flow path formed by the first heat transfer tube having a flow path length equal to that of a second refrigerant flow path formed by the second heat transfer tube, and
an internal pressure loss of the first heat transfer tube being smaller than an internal pressure loss of the second heat transfer tube.

16. The heat exchanger according to claim 15, wherein
the first heat transfer tube has an outer shape identical to that of the second heat transfer tube.

17. A refrigeration cycle apparatus comprising a compressor, a flow path switching unit, a decompression unit, a first heat exchanger, and a second heat exchanger,
the flow path switching unit being provided to switch between a first state in which refrigerant flows successively through the compressor, the first heat exchanger, the decompression unit, and the second heat exchanger, and a second state in which the refrigerant flows successively through the compressor, the second heat exchanger, the decompression unit, and the first heat exchanger, and
the first heat exchanger being provided as the heat exchanger according to claim 1, and being disposed such that the distributor is located downstream of the first heat transfer tube and the second heat transfer tube in a direction in which the refrigerant flows in the first state, and the distributor is located upstream of the first heat transfer tube and the second heat transfer tube in the direction in which the refrigerant flows in the second state.

* * * * *